US005617966A

United States Patent [19]

Bral

[11] Patent Number: 5,617,966

[45] Date of Patent: Apr. 8, 1997

[54] AUTOMATICALLY RINSING BABY BOTTLE

[75] Inventor: Hooshang Bral, Beverly Hills, Calif.

[73] Assignee: RXI Management, Corp., Los Angeles, Calif.

[21] Appl. No.: 356,723

[22] Filed: Dec. 15, 1994

Related U.S. Application Data

[63] Continuation of Ser. No. 274,204, Jul. 12, 1994, abandoned.

[51] Int. Cl.[6] ..... A61J 9/00

[52] U.S. Cl. ..... 215/11.4; 215/6

[58] Field of Search ..... 215/11.1, 11.3, 215/11.4, 6, 385; 222/129, 145.1, 477, 566

[56] References Cited

U.S. PATENT DOCUMENTS

| | | | |
|---|---|---|---|
| 2,655,279 | 10/1953 | Wolf | 215/11 |
| 2,680,441 | 6/1954 | Krammer | 128/233 |
| 2,786,769 | 3/1957 | Greenspan | 99/171 |
| 3,741,383 | 6/1973 | Wittwer | 206/47 A |
| 4,410,085 | 10/1983 | Beneziat et al. | 215/6 X |
| 4,548,339 | 10/1985 | Gorman | 215/6 X |
| 4,821,895 | 4/1989 | Roskilly | 215/11.1 |
| 4,856,995 | 8/1989 | Wagner . | |
| 5,029,701 | 7/1991 | Roth et al. . | |
| 5,244,122 | 9/1983 | Botts | 222/133 |
| 5,437,381 | 8/1995 | Herrmann . | |

FOREIGN PATENT DOCUMENTS

| | | | |
|---|---|---|---|
| 1288859 | 2/1962 | France | 383/80 |
| 2285790 | 7/1995 | United Kingdom . | |
| WO9524177 | 9/1995 | WIPO . | |

*Primary Examiner*—Allan N. Shoap
*Assistant Examiner*—Christopher J. McDonald
*Attorney, Agent, or Firm*—Darby & Darby

[57] ABSTRACT

A nursing bottle for automatically rinsing a baby's teeth, includes a bottle for storing a first liquid which has an open end for receiving the first liquid. A nipple is releasably mounted on the open end of the bottle for dispensing the first liquid through at least one discharge hole. A storage device for storing a second liquid has a dispensing end adjacent the nipple for dispensing the second liquid. The dispensing end of the storage device has a retainer for retaining the second liquid within the storage means until the first liquid is dispensed from the bottle, afterwhich the retainer automatically releases the second liquid into the nipple, automatically rinsing the baby's teeth by dispensing the second liquid through the at least one discharge hole.

16 Claims, 4 Drawing Sheets

AUTOMATICALLY RINSING BABY BOTTLE

This application is a continuation in part of Ser. No. 08/274,204, filed Jul. 12, 1994, now abandoned.

FIELD OF THE INVENTION

This invention relates generally to a nursing bottle, and more particularly to a nursing bottle for babies over eight months of age which automatically rinses the baby's teeth after the contents of the nursing bottle have been emptied, thus preventing decay of the baby's teeth.

BACKGROUND OF THE INVENTION

Typically, a baby goes to sleep after drinking a bottle of milk or formula from a nursing bottle. Frequently, a baby will fall completely asleep with a nursing bottle in its mouth while still drinking from the bottle. This results in the milk or other contents from the nursing bottle maintaining contact with the baby's teeth for extended periods of time which results in tooth decay of the baby's teeth.

A number of improvements have been made to the conventional nursing bottle for administering a second liquid which is distinct from the contents of the nursing bottle. However, these improvements have typically been in the area of medicine dispensing in connection with a nursing bottle. For example, U.S. Pat. No. 2,680,441 to Krammer, issued Jun. 8, 1954, discloses a nursing bottle having a separate syringe attached to the nipple of the nursing bottle. The syringe contains a rubber bulb adjacent to the closed end of the bottle which must be manually depressed to evacuate the contents of the syringe. More recently, U.S. Pat. No. 4,821,895 to Roskilly, issued Apr. 18, 1989, discloses a nursing bottle having a separate syringe attached to the nipple. The plunger of the syringe must be manually depressed to administer the contents of the syringe into the nipple of the nursing bottle. Likewise, U.S. Pat. No. 5,244,122 to Botts, issued Sep. 14, 1993, also discloses a nursing bottle having a manually operated syringe disposed within the nursing bottle. However, as with the prior art, the plunger of the syringe must be manually operated which is inconvenient.

A related type of nursing bottle comprises two separate compartments within the nursing bottle, wherein one compartment is punctured to release the contents in the second compartment. For example, U.S. Pat. No. 2,786,769 to Greenspan, issued Mar. 26, 1957, discloses a nursing bottle having an inner compartment which is punctured using a threaded shank or screw and must be manually operated from the exterior of the nursing bottle. Similarly, U.S. Pat. No. 3,741,383 to Wittwer, issued Jun. 26, 1973, discloses a nursing bottle having an inner compartment which is punctured with a sharp object such as a needle prior to administering the contents of the nursing bottle.

Another nursing bottle design is disclosed in U.S. Pat. No. 2,655,279 to Wolf, issued Oct. 13, 1953, wherein a flexible tube having a weighted end is placed within the nursing bottle. The tube has a hollow bore running throughout which allows passage of the contents of the nursing bottle to the nipple. The first end of the tube is attached to the nipple while the second end of the tube is placed near the bottom surface of the nursing bottle. The weighted member enables the tube to bend when the nursing bottle is moved from a vertical to a horizontal orientation. Thus, the second end of the tube remains submerged in the contents of the nursing bottle regardless of the orientation of the bottle which eliminates excess air. However, this nursing bottle does not provide two separate compartments for delivering two separate liquids but instead provides a tube for delivering one liquid.

Another medicine dispensing nursing bottle is disclosed in U.S. Pat. No. 5,029,701 to Roth at al., issued Jul. 9, 1991, which has the medication vile disposed within the bottle. However, this nursing bottle does not allow any liquid to be dispensed from within the bottle itself but only from the medication vile which is completely sealed in relation to the nipple. Thus, the bottle only houses the vile and is not in open communication with the it.

SUMMARY OF THE INVENTION

Accordingly, it is an object of the present invention to provide an improved nursing bottle for rinsing a baby's teeth after drinking formula from the nursing bottle.

It is a further object of the present invention to provide a nursing bottle for rinsing a baby's teeth by automatically dispensing a second liquid independent of and subsequent to a first liquid.

In carrying out the above and other objects of the invention in one form, there is provided a nursing bottle for automatically rinsing a baby's teeth, preferably comprising a bottle for storing a first liquid having an open end for receiving the first liquid, a nipple mounted on the open end of the bottle for dispensing the first liquid through at least one discharge hole, a storage device for storing a second liquid having a dispensing end adjacent the nipple for dispensing the second liquid, and a retainer positioned on the dispensing end of the storage device for retaining the second liquid within the storage device until the first liquid is dispensed from the bottle, afterwhich the retainer automatically releases the second liquid into the nipple, thereby automatically rinsing the baby's teeth by dispensing the second liquid through the at least one discharge hole.

DETAILED DESCRIPTION OF THE INVENTION

Figure 1:
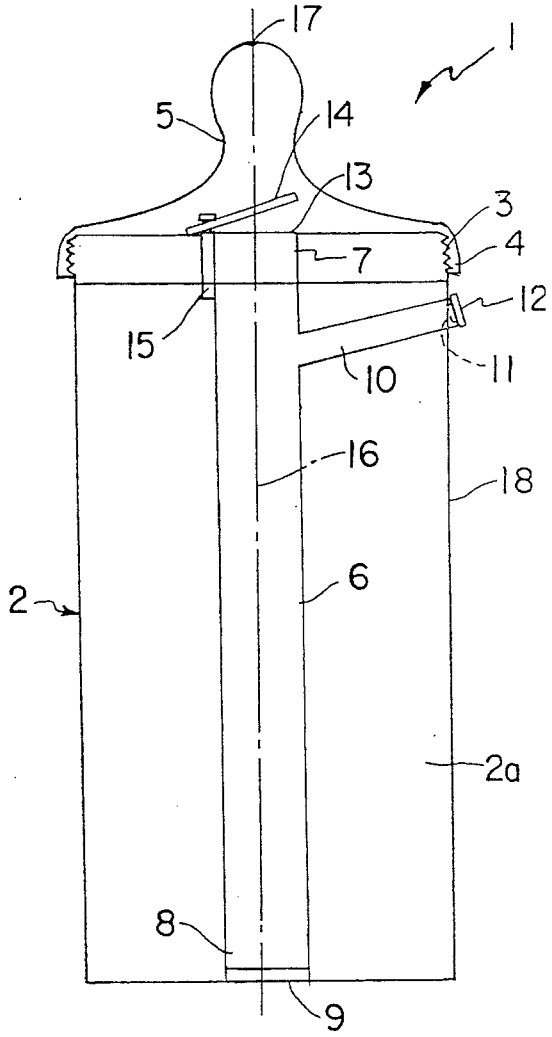
FIG. 1 is a side view of the preferred nursing bottle of the present invention.

Referring to FIGS. 1–9, a nursing bottle 1 for babies over the age of eight months includes a conventional bottle 2 having a screw-threaded neck 3, an annular screw-threaded bottle top 4, and a rubber teat or nipple 5 as is well known in the art. The bottle 2 receives a first liquid 2*a* such as milk or baby formula. The nursing bottle 1 may be disposable as is well known in the art.

Figure 3:
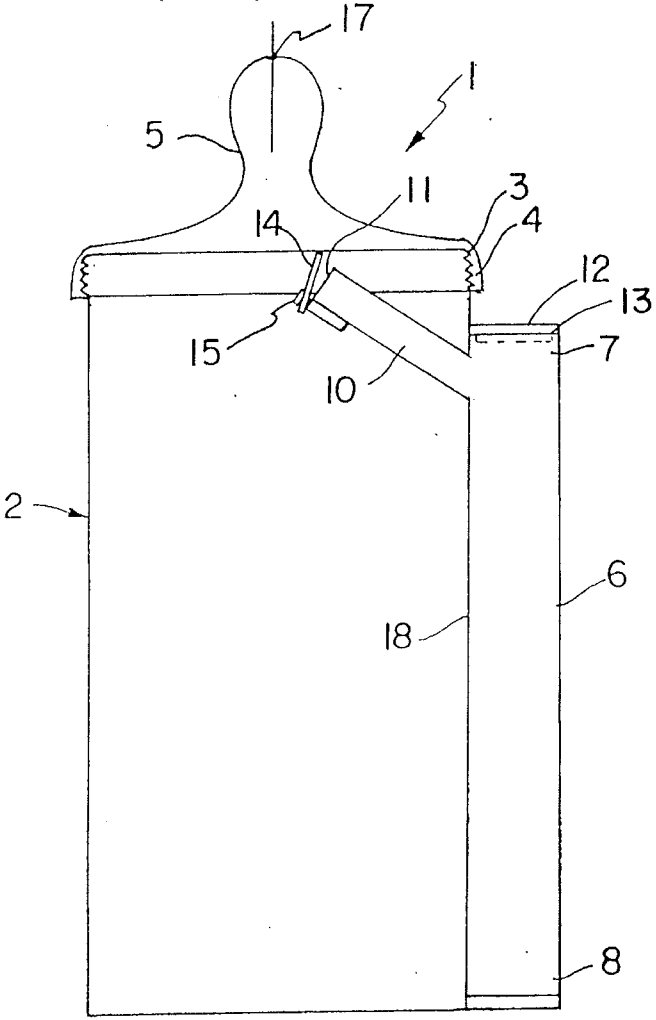

The nursing bottle 1 preferably contains a storage device in the form of a hollow tube 6 within the bottle 2. The tube 6 has first and second ends 7 and 8, respectively, wherein the first end is positioned in close proximity to the nipple 5 while the second end 8 is positioned in close proximity to an end wall 9 of the bottle 2. In the preferred embodiment, the tube 6 is positioned within the bottle 2; however, the tube 6 may be positioned on the exterior of the bottle 2 as shown in FIG. 3. Furthermore, the tube 6 may comprise an armature 10 having an opening 11 in a side wall 18 of the bottle 2 for insertion of a second liquid 6*a* such as water or a liquid containing fluoride. The opening 11 is preferably sealed with a removable cap 12. The tube 6 may also be filled using an opening 13 at the first end 7 of the tube 6 as shown in FIGS. 1, 3, 4, 5, 6 and 7. As with the bottle 2, the tube 6 may also be disposable.

Figure 2:
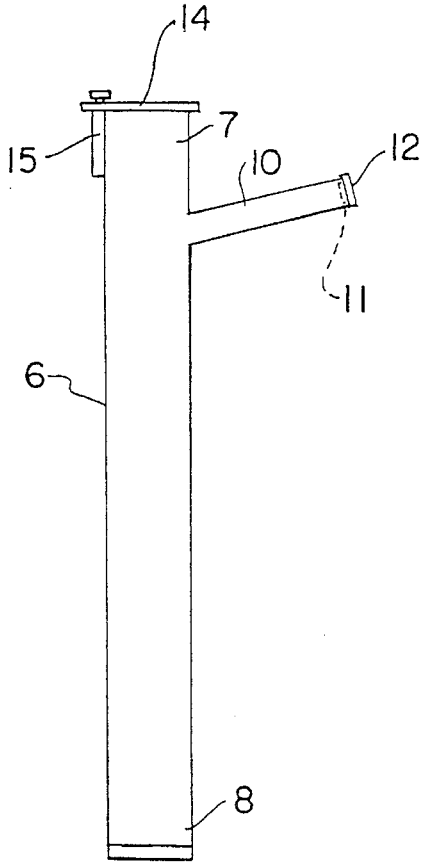
FIG. 2 is a side view of the preferred tube of the present invention.

Referring to FIGS. 1 and 2, the opening 13 is preferably covered by a lid 14 which is attached by a hinge 15 to the tube 6. The tube 6 is also preferably filled through the opening 11, afterwhich the cap 12 is inserted to seal the opening 11.

Referring to FIG. 3, in an alternate embodiment, the tube 6 is placed on the exterior of the bottle 2. The tube 6 is filled with the second liquid 6*a* through the opening 13, afterwhich the opening 13 is sealed with the cap 12. The second liquid 6*a* is retained within the tube 6 by the lid 14 which covers the opening 11.

Figure 4:
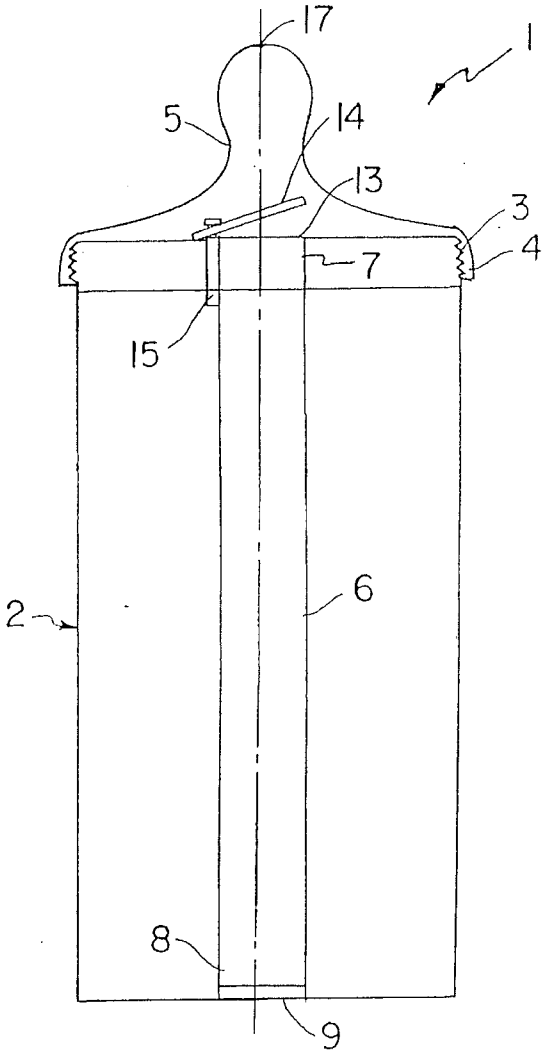
FIGS. 3–7 are side views of alternate embodiments of the present invention.

Referring to FIG. 4, in an alternate embodiment, the tube is filled with the second liquid 6*a* through the opening 13, which is also used to dispense the second liquid 6*a*. The second liquid 6*a* is retained by the lid 14.

Figure 7:
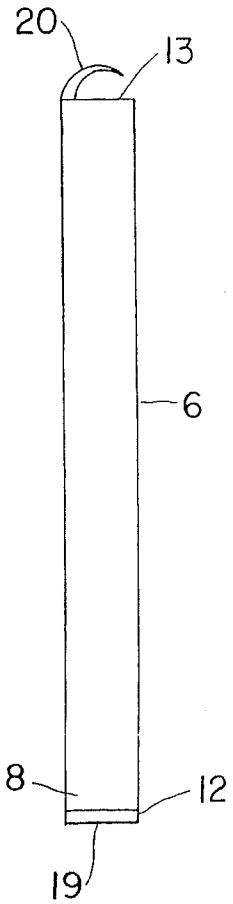
Figure 6:
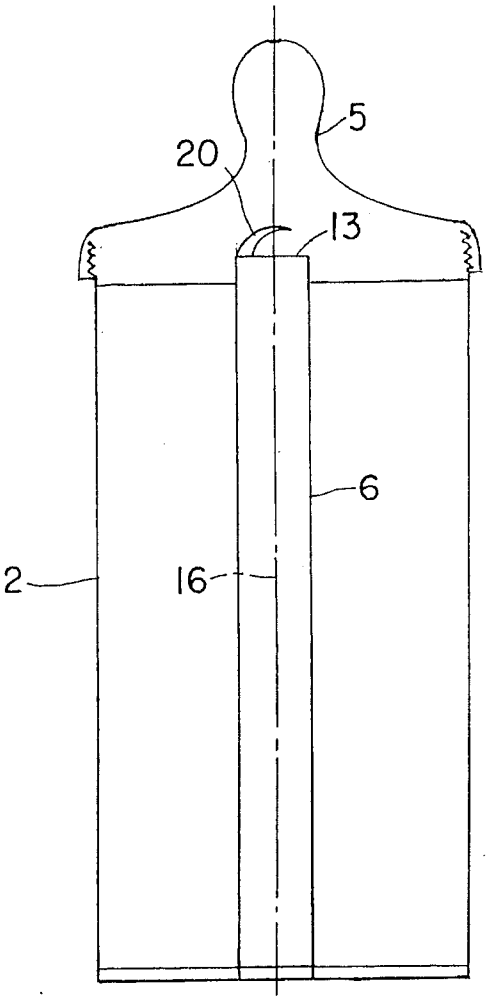
Figure 5:
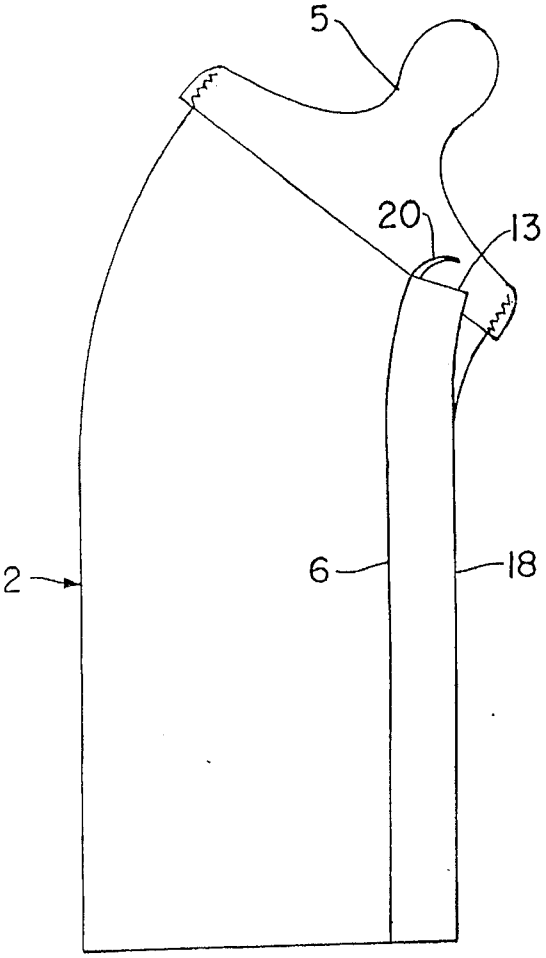

Referring to FIGS. 5–7, in an alternate embodiment, the tube 6 is filled through an opening 19 which is sealed at the second end 8 with the cap 12. The second fluid is then dispensed through the opening 13. The bottle 2 may be configured to facilitate drainage as shown in FIG. 5.

The cap 12 may comprise a rubber stopper which engages the respective opening using a press fit or the cap 12 may threadably engage the respective opening, both of which are well known in the art. Furthermore, the tube may be prefilled and disposable for convenience, thus eliminating the need for any type of cap.

Figure 8:
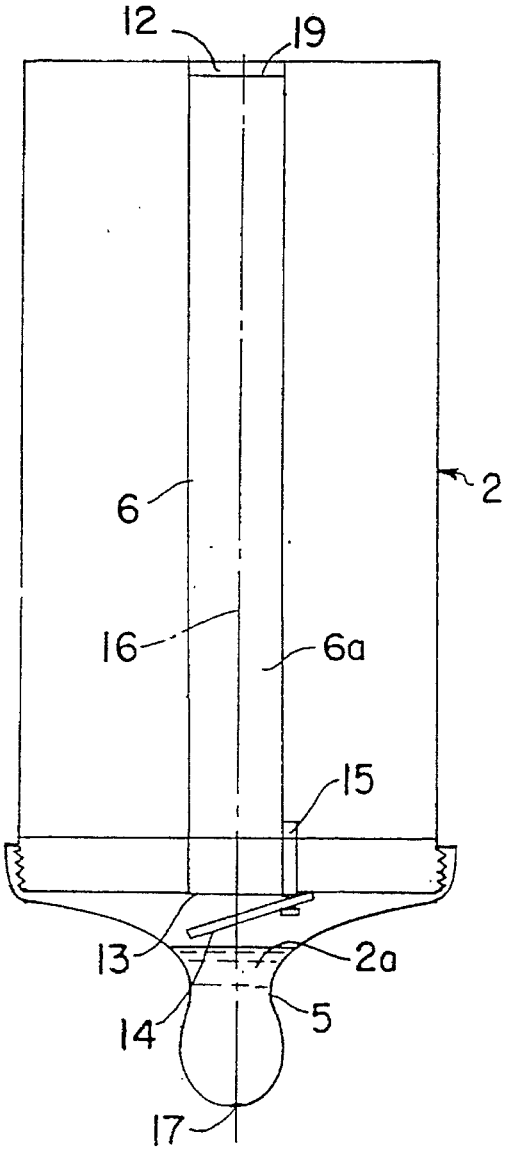
FIGS. 8 and 9 are side views of the preferred and alternate embodiments of the present invention in operation.

Referring to FIG. 8, in operation, the bottle 2 is fried with the first liquid 2*a* such as baby formula or other liquid and the tube 6 is filled with a second rinsing liquid 6*a* such as water. When a vertical axis 16 as shown in FIG. 1 is moved such that the nipple 5 is in a horizontal or downwardly directed orientation, the pressure of the formula forces the lid 14 to remain closed, thus preventing the contents of the tube 6 from dispensing. When the contents of the bottle 2 have emptied, such as when the baby has finished drinking all of the formula or other liquid within the bottle 2, the pressure of the second rinsing liquid 6*a* will force the lid 14 to move to an open position as shown in FIGS. 1, 3 and 4. Until the contents of the bottle 2 are emptied, the lid 14 will remain in a substantially closed position as shown in FIG. 2.

When substantially all of the first liquid 2*a* of the bottle 2 is emptied, the rinsing liquid 6*a* of the tube 6 will force the cover 14 to open and thus enter the nipple 5 of the bottle 2. The baby will then continue to feed on the bottle thus delivering water or fluoride liquid into the baby's mouth through a discharge opening 17 in the nipple 5. The water will then rinse the formula from the baby's mouth, thus preventing tooth decay. Unlike the prior art, the present invention automatically delivers the rinsing solution to the baby. Therefore, it is not necessary to manually dispense the rinsing solution to the baby after having fed on the formula. A further advantage of the present invention is that it is not necessary to monitor the baby's bottle to determine when the rinsing solution should be dispensed.

Figure 9:
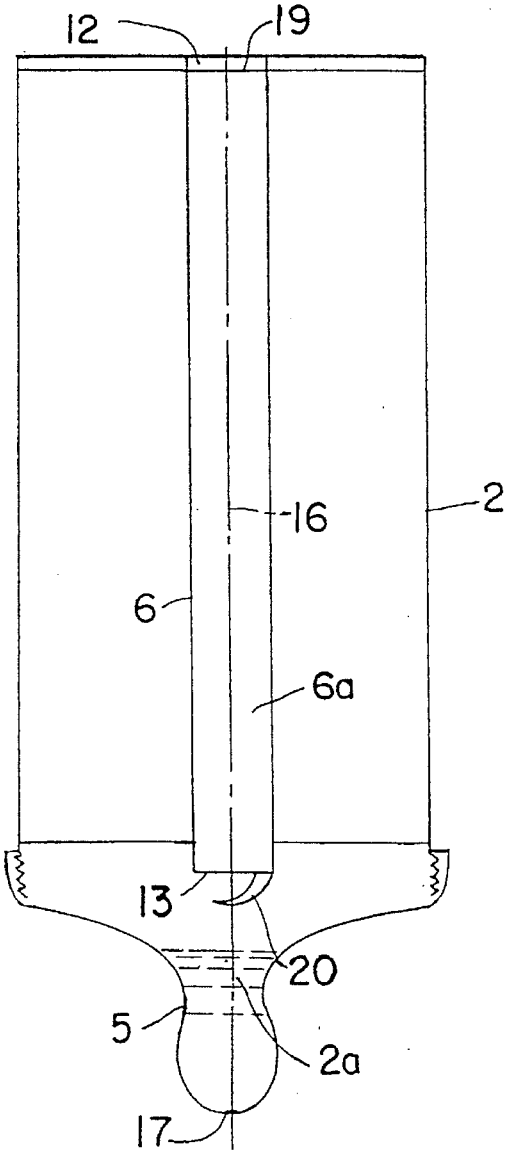

Referring to FIG. 9, in an alternate embodiment, the second rinsing liquid 6*a* is retained by an extension 20 which is preferably curved and projects substantially over the opening 13. The second liquid 6*a* will remain within the tube 6 as long as the first fluid remains in the bottle 2. However, once the first liquid 2*a* is dispensed from the bottle 2 such that the second liquid 6*a* is below the level of the opening 13, the second liquid 6*a* will automatically dispense into the nipple 5.

The nursing bottle 1 may be used to dispense medication as in the prior art. However, unlike the prior art, the present invention automatically dispenses the medication to the baby after the contents of the bottle 2 have been evacuated. This would be desirable in a situation where the medication was to be taken by the baby on a full stomach.

While the embodiment of the invention shown and described is fully capable of achieving the results desired, it is to be understood that this embodiment has been shown and described for purposes of illustration only and not for purposes of limitation. Other variations in the form and details that occur to those skilled in the art and which are within the spirit and scope of the invention are not specifically addressed. Therefore, the invention is limited only by the appended claims.

What is claimed is:

1. A nursing bottle for automatically rinsing a baby's teeth, comprising:

bottle means for storing a first liquid having an open end for receiving said first liquid;

nipple means mounted on said open end of said bottle means for dispensing said first liquid through at least one discharge hole;

storage means for storing a second liquid having a dispensing end adjacent said nipple means for dispensing said second liquid; and retaining means positioned on said dispensing end of said storage means which retains said second liquid within said storage means until said first liquid is substantially dispensed from said bottle means, whereby the force of gravity acts on said retaining means when said bottle means is at least substantially inverted, afterwhich said retaining means opens, thereby releasing said second liquid from said storage means into said nipple means to rinse the baby's teeth by dispensing said second liquid through said at least one discharge hole.

2. The nursing bottle of claim 1, wherein said storage means is releasably attached.

3. The nursing bottle of claim 2, wherein said storage means is disposable.

4. The nursing bottle of claim 1, wherein said storage means further comprises an opening opposite of said dispensing end for receiving said second liquid.

5. The nursing bottle of claim 4, wherein said opening is sealed with a pliable cap.

6. The nursing bottle of claim 4, wherein said opening is sealed with a threadably engaging cap.

7. The nursing bottle of claim 1, wherein said storage means is mounted on the interior of said bottle means.

8. The nursing bottle of claim 1, wherein said storage means is mounted on the exterior of said bottle means.

9. The nursing bottle of claim 1, wherein said retaining means comprises an extension which projects substantially over said dispensing end.

10. The nursing bottle of claim 9, wherein said extension is substantially curved.

11. The nursing bottle of claim 1, wherein said retaining means comprises a lid mounted to said storage means using a hinge.

12. The nursing bottle of claim 11, wherein said lid is removably attached to said storage means.

13. The nursing bottle of claim 1, wherein said second liquid is received within said storage means through an opening in a side wall of said bottle means.

14. The nursing bottle of claim 13, wherein said opening is sealed with a pliable cap.

15. The nursing bottle of claim 13, wherein said opening is sealed with a threadably engaging cap.

16. The nursing bottle of claim 1, wherein said dispensing end is capable of receiving said second liquid.

* * * * *

UNITED STATES PATENT AND TRADEMARK OFFICE

CERTIFICATE OF CORRECTION

PATENT NO. : 5,617,966
DATED : April 8, 1997
INVENTOR(S) : Hooshang Bral

It is certified that error appears in the above-indentified patent and that said Letters Patent is hereby corrected as shown below:

On title page, item [63]

Under Related U.S. Application Data:

"Continuation of Ser. No." should be

--Continuation In Part of Ser. No.--

Signed and Sealed this

Twenty-fourth Day of June, 1997

Bruce Lehman

*Attest:*

BRUCE LEHMAN

*Attesting Officer*

*Commissioner of Patents and Trademarks*